United States Patent [19]

Moehren

[11] 4,365,744

[45] Dec. 28, 1982

[54] ANCHOR LOCK FASTENING ASSEMBLY

[76] Inventor: Hans-Heiner Moehren, 514 Holly Rd., Yeadon, Pa. 19050

[21] Appl. No.: 188,866

[22] Filed: Sep. 19, 1980

[51] Int. Cl.[3] ..... E01B 9/48; E01B 9/64; E01B 13/02

[52] U.S. Cl. ..... 238/323; 238/299; 238/310; 238/327 R; 238/349

[58] Field of Search ..... 238/299, 310, 314, 315, 238/321, 323, 327 R, 327 A, 338, 343, 344, 349

[56] References Cited

U.S. PATENT DOCUMENTS

| | | | |
|---|---|---|---|
| 1,063,374 | 6/1913 | Morgan | 238/299 X |
| 1,259,827 | 3/1918 | Bouchard, Jr. | 238/338 X |
| 1,483,827 | 2/1924 | Miller | 238/349 X |
| 1,580,542 | 4/1926 | Smith | 238/299 X |
| 1,680,131 | 8/1928 | Corl | 238/299 |
| 3,065,914 | 11/1962 | Rigby | 238/349 |
| 3,494,554 | 2/1970 | Hall | 238/349 X |
| 3,664,584 | 5/1972 | Novotny | 238/349 |
| 4,175,700 | 11/1979 | Gehrke | 238/299 |

FOREIGN PATENT DOCUMENTS

| | | | |
|---|---|---|---|
| 667912 | 11/1938 | Fed. Rep. of Germany | 238/323 |
| 854366 | 11/1952 | Fed. Rep. of Germany | 238/310 |

OTHER PUBLICATIONS

"FIST-BTR, Rail Fastening System for Concrete Sleepers".

"B-TREC", Tempered Railway Equipment Co.

"Woodings Rail Anchor", Woodings-Verona Transportation Products, Verona, Pa. 15147.

"Sidewinder (The System)", Portec, Inc., Railway Products Div., 300 Windsor Dr., Oakbrook, Ill. 60521.

"Unit", Unit Rail Anchor Company, Suite 2336, Two North Riverside Plaza, Chicago, Ill. 60606.

"The Last Word In Fasteners for Concrete Ties", Plant City Steel Co., RB Industries, Inc., Box 169011, Tampa, Fla., 33687.

*Primary Examiner*—Randolph Reese

*Attorney, Agent, or Firm*—Birch, Stewart, Kolasch & Birch

[57] ABSTRACT

A substantially load free anchor lock fastening assembly which comprises an anchor lock and a rail anchor, said anchor lock forming part of a plate or attachment to a tie or rail support, and containing an engaging and locking portion for providing a loose connection with the rail anchor, and said rail anchor containing portions adapted to engage with the base of a rail and loosely engage the anchor lock so as to enable the rail anchor to control the vertical position of the rail without exerting compressive forces between the rail and the rail support, said substantially load free fastening of the rail leaving the rail free to float.

19 Claims, 10 Drawing Figures

ANCHOR LOCK FASTENING ASSEMBLY

BACKGROUND AND SUMMARY OF THE INVENTION

The present invention is directed to an anchor lock fastening assembly (ALFA) which provides the function of holding the rail to the railroad tie while at the same time preventing longitudinal displacement of the rail. More particularly, the present invention is directed to a floating rail fastening assembly wherein limited vertical movement between the floating rail and the railroad cross tie is provided by an anchoring system which avoids the use of compressive forces (toe loads) for anchoring the rail as utilized by the prior art.

Most of the rail fastening devices of the prior art fall into one of the following categories. A first category is a positive fastening-type device which exerts a toe load of approximately 4,000 to 6,000 pounds on the base of the rail by means of a set of spring clips or spring loaded caps anchored by means of inserts or shoulders cast into the concrete tie. Exemplary of this type of device is shown in the PORTEC advertisement entitled Sidewinder (the system). Other similar types of devices are shown in the UNIT-D.E. SPRING CLIP advertisement by UNIT-D.E. INC. In all such devices, because of the toe load fastening, the ties tend to follow the vertical movements of the rail under the pulsating loads of passing trains which, particularly under wet environmental conditions, produces a a suction effect which causes subgrade material to migrate into the ballast, thereby adversely affecting drainage roadbed stability and the structural integrity of the ties. In addition, the high toe loads required by the positive fastening device substantially compresses the cushioning pads used in conjunction with the tie, thereby unloading the clips and causing rail slippage. If damaged, the clip retaining inserts or shoulders often necessitate the replacement of the entire cross tie.

The second type of rail fastening device known in the prior art is a rail free or floating fastening which does not provide a toe loading function as described hereinabove but rather utilizes a combination of cut spike and anchor wherein the spike is driven into the tie in such a manner as to permit limited vertical movement between the tie plate and the base of the rail. The anchor prevents the rail from creeping or slipping, that is, moving longitudinally under the effect of forces caused by temperature changes in the rail or by accelerating or decelerating trains. With few exceptions, the positive fastening device is a typical European design for both wood and concrete tie whereas the rail free cut spike and anchor fastening device is commonly utilized in the United States. It should be noted however that the concrete tie together with positive fastenings is being tested on numerous test sites in the United States where fastening performance is a matter of growing concern.

Although the rail free or floating fastening device of the prior art which is utilized on wooden ties, provides an economical method of fastening the rails to the ties, the increased loads produced on the rail by modern, heavy freight trains tend to cause rail roll-over and gage widening. As a result the spikes become loose, necessitating frequent repair of the ties and regaging of the rails which substantially reduces the life of the railroad tie. In addition, varying installation conditions adversely affect the fastening effect or holding power of the cut spikes which act like splitting wedges in the railroad ties. This type of fastening cannot be used on concrete ties although anchors are sometimes used to prevent rail movements occurring with clip type fastenings.

Accordingly, an object of the present invention is to provide an anchor lock rail fastening assembly which substantially eliminates the problems encountered in the prior art devices, such as is exemplified by the positive fastening devices and the conventional rail free or floating fastening device.

Another object of the present invention is to provide a floating rail fastening assembly wherein limited vertical movement between the floating rail and the railroad cross tie is achieved by an anchoring system which avoids the use of compressive forces (toe loads) for anchoring the rail to the tie.

A further object of the present invention is to provide an anchor lock rail fastening assembly which consists of a minimum number of components, allows for mechanized assembly, and is substantially maintenance free.

Still another object of the present invention is to provide a floating rail fastening assembly which provides substantially improved rail-wheel contact for high speed operation.

Yet another object of the present invention is to provide a fail-safe electrical insulating device.

A still further object of the present invention is to provide a fastening device that can be used both on wood and concrete ties.

Yet a further object of the present invention is to provide a fastening device that makes possible the choice of a rail cushioning pad, the resilience of which is a function of the load to be cushioned rather than to suit the spring rate of a particular clip design.

Still another object of the present invention is to provide a fastening device that provides permanent longitudinal and lateral restraint of the rail.

Yet another object of the present invention is to provide a fastening device, which if damaged, does not in turn cause damage or loss of the concrete tie.

Another object of the present invention is to provide a fastening device that resists both corrosion and abrasion.

Other objects and further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the prior art disadvantages have been eliminated and the objects of the present invention have been achieved by providing an anchor lock rail fastening assembly. According to the present invention, the proposed anchor lock rail fastening assembly incorporates a novel anchor lock which by passively restricting the vertical movement of a known spring type anchor, is effective in dispensing with toe loading of rails on concrete ties and the use of rail spikes on wood ties.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
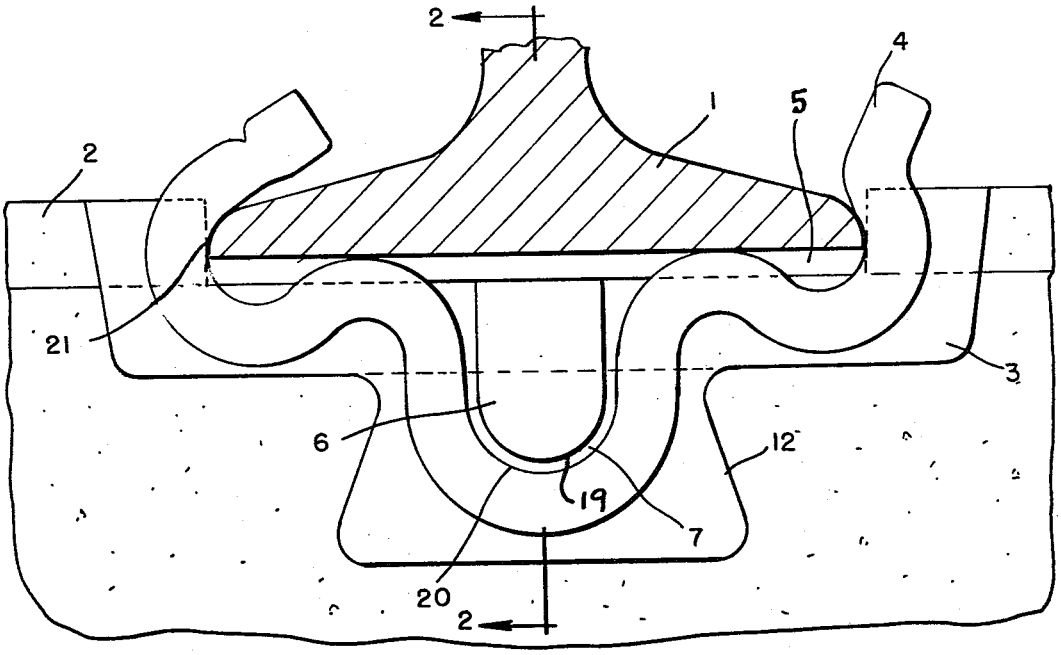
FIG. 1 shows a side view of the anchor lock rail fastening assembly of the present invention.
Figure 1A:
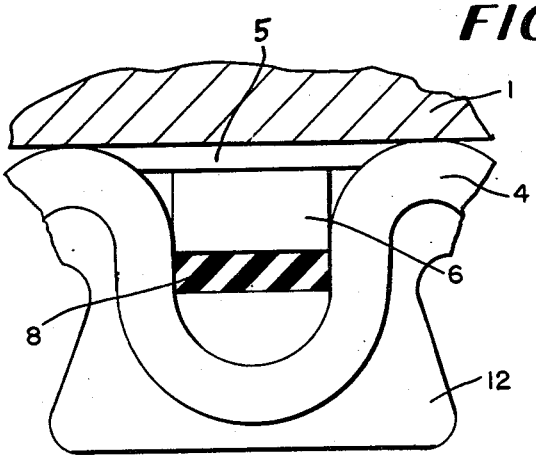
FIG. 1A shows one embodiment of the anchor lock protrusion device of FIG. 1.
Figure 1B:
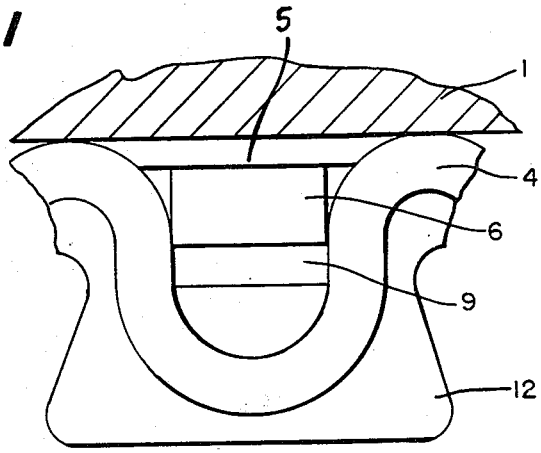
FIG. 1B shows another embodiment of the anchor lock protrusion device of FIG. 1.

The present invention will now be described, in detail, in connection with the drawings wherein like reference numerals are used throughout the various views to indicate like parts. The anchor lock rail fastening assembly of the present invention as shown in FIG. 1, comprises a rail 1 which is disposed in an anchor lock plate 3, which in turn is positioned within the railroad tie 2. The anchor lock plate advantageously has side flanges 12 in a dovetail configuration which provides electrical insulation between the anchor 4 and the tie 2 and securely holds the anchor lock plate within the concrete railroad tie. The anchor lock plate is also provided with anchor lock protrusions 6 on opposite lateral sides thereof. The anchor lock protrusions are provided with a surface 19 which is adapted to operatively engage the interlocking portion 20 of the rail anchor 4. The rail anchor 4 also engages in a tight grip both sides of the rail with the rail engaging portion 21. According to the embodiment shown in FIG. 1, a small gap 7 is provided between the anchor lock protrusion and the rail anchor, thereby providing a free connection between the tie and the rail whereby no clamping force (i.e., no toe load) is exerted between the rail anchors and the anchor lock protrusions. Accordingly, a desired, but limited vertical movement of the floating rail will avoid the uplifting of the cross tie. Optionally, a resilient pad 5 which can be made of a polymeric material or a natural rubber material is provided between the rail 1 and the anchor lock plate 3 to produce additional cushion to the rail. On concrete ties the anchor lock plate 3 is advantageously made of a non-conductive rigid material such as for example, high density polyethylene. FIG. 1A shows a further embodiment of the present invention wherein the anchor lock protrusion contains a resilient portion 8 which absorbs high frequency vertical vibrations in a more effective manner than the gap 7. FIG. 1B shows the use of a gap 9 which is disposed in the anchor lock protrusion rather than in the area surrounding the anchor lock protrusion. The elasticity of the anchor lock protrusion itself is thus used to absorb said vibtrations.

Figure 2:
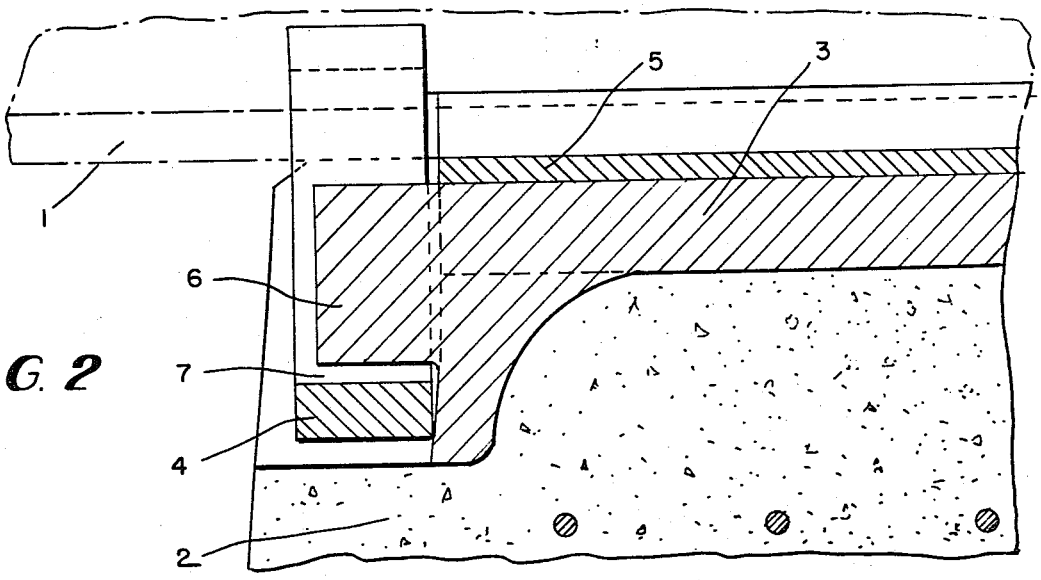
FIG. 2 shows a cross section of the anchor lock rail fastening assembly of FIG. 1 taken along line 2—2 of FIG. 1.

FIG. 2 is a cross section taken along line 2—2 of FIG. 1 clearly showing that the anchor lock plate is made of two symmetrical parts, recessed from the lateral surface of the railroad tie. This design protects the anchor lock protrusion 6 and allows for on site replacement of damaged anchor lock plates.

Figure 2A:
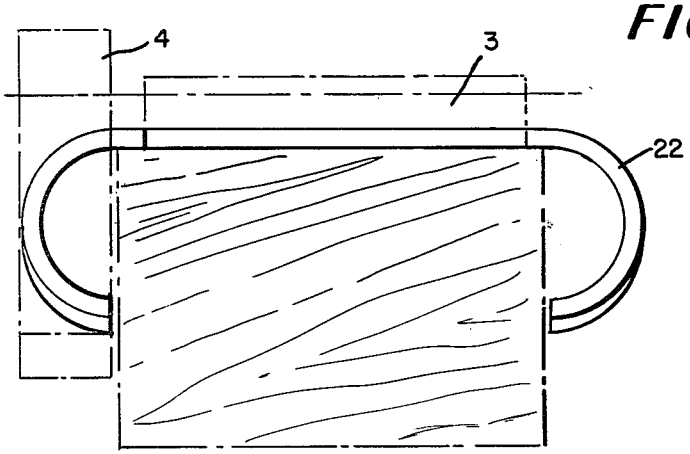
FIG. 2A shows another embodiment of the anchor lock plate of FIG. 2; in conjunction with wooden ties and conventional tie plate.

FIG. 2A shows an embodiment of an anchor lock plate 22 which contains a spring-like anchor lock end portion utilized in connection with wooden ties wherein the plate is embedded in the wooden tie where it is held in position by the standard tie plate. The anchor lock protrusions loosely engage with the tie bearing portion of the anchor for holding down the floating rail.

Figure 3:
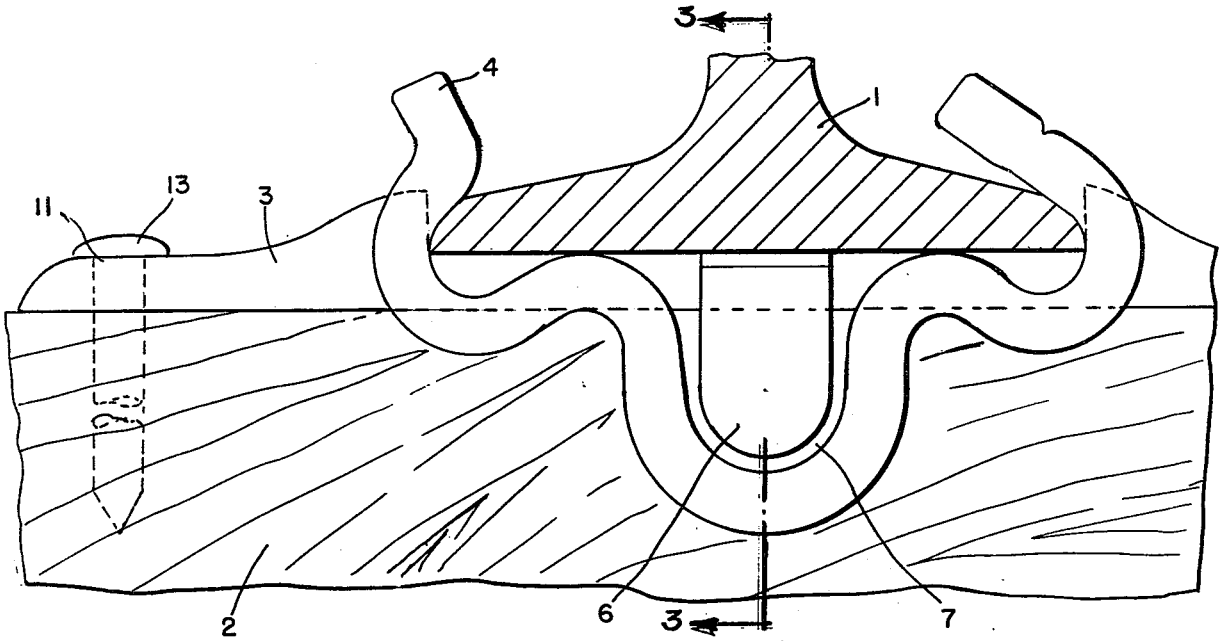
FIG. 3 shows a side view of still another embodiment of the anchor lock plate of the present invention utilized in conjunction with wooden ties.

FIG. 3 shows the anchor lock rail fastening assembly of the present invention as applied to wooden ties. In this embodiment the tie plate 3 which is permanently fastened to the tie with a spike having a head portion 13 and shaft portion 11 is provided with lateral anchor lock protrusions 6 which are adapted to operatively engage with the tie-bearing section of the rail anchor 4. The gap 7 provides the same function as that discussed in connection with FIG. 1 of the present application.

Figure 3A:
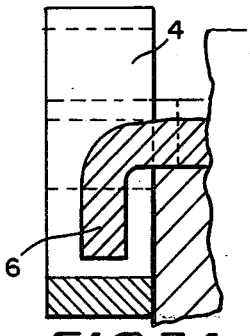
FIG. 3A shows a cross section of the anchor lock rail fastening assembly of FIG. 3 taken along line 3—3 of FIG. 3.

FIG. 3A represents a cross section taken along line 3—3 of FIG. 3 showing the relationship between the anchor 4 and the anchor lock protrusion 6.

Figure 4:
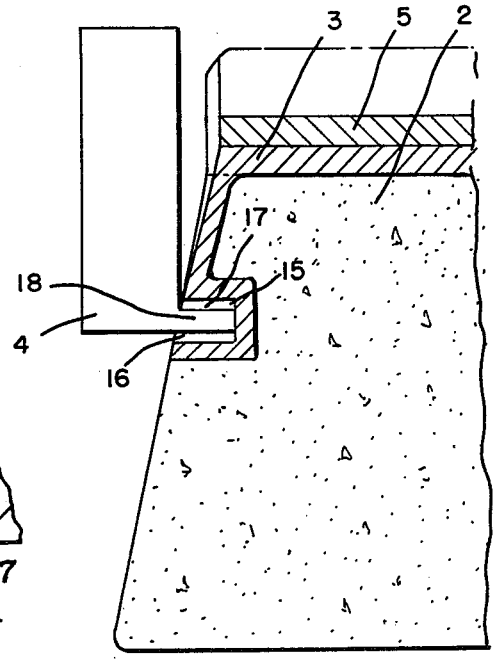
FIG. 4 shows another embodiment of the anchor lock rail fastening assembly of the present invention for use in conjunction with concrete ties.

FIG. 4 shows the embodiment of the present invention wherein the anchor lock plate is provided with lateral recessed portions 15 which extend into the side of the concrete tie. The floating rail fastening assembly of the present invention thus comprises a rail anchor 4 which contains an anchor lock protrusion 18 which is adapted to loosely engage with the lateral recessed portion 15 leaving gaps 16 and 17 on opposite sides thereof. Advantageously the anchor lock plate 3 with the recess 15 is made of an insulating material.

Figure 4A:
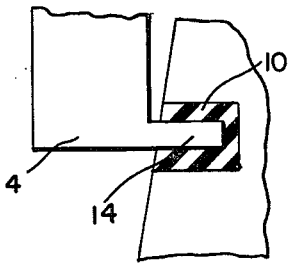
FIG. 4A shows a modification of the embodiment shown in FIG. 4.

FIG. 4A shows an embodiment of the present invention wherein the recessed portion of the anchor lock plate 3 contains an insert made of a resilient material 10 which cooperates with the protruding portion 14 of the rail anchor 4 for providing a resilient engagement between the anchor lock plate 3 and the rail anchor.

Figure 5:
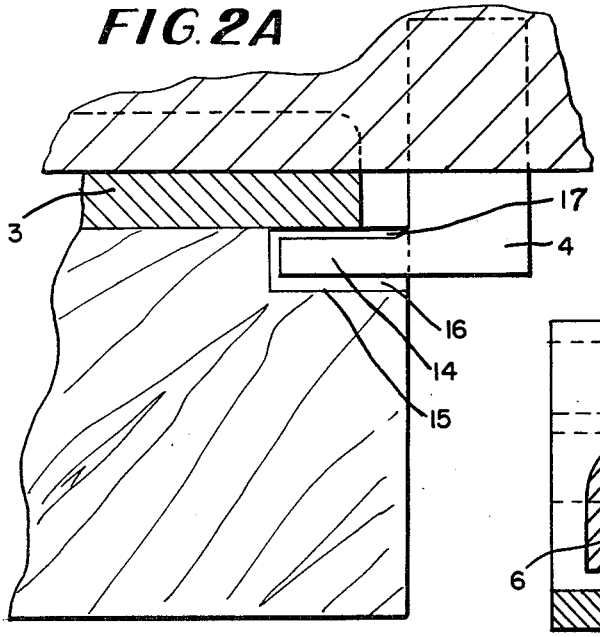
FIG. 5 shows still a further embodiment of the anchor lock rail fastening assembly of the present invention utilized in conjunction with wooden ties.

FIG. 5 shows an embodiment of the present invention which is similar to FIG. 4 but applies rather to wood ties. In this embodiment the anchor lock recess is a carved out portion in the wood ties which is covered by a standard tie plate, thereby defining the anchor lock recess 15 for receiving the anchor lock protrusion 14. The anchor lock protrusion extends into the recess 15 leaving gaps 16 and 17 on both sides thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A substantially load free anchor lock fastening assembly which comprises an anchor lock and a rail anchor, said anchor lock forming part of a plate or attachment to a tie or rail support, and containing an engaging and locking portion for providing a loose connection with the rail anchor, and said rail anchor being unitary and containing portions adapted to engage with the base of a rail and loosely engage the anchor lock so as to enable the rail anchor to control both the vertical and the longitudinal positions of the rail without exerting compressive forces between the rail and the rail support, said substantially load free fastening of the rail leaving the rail free to float.

2. The substantially load free anchor lock assembly of claim 1 wherein the anchor lock contains lateral protrusions extending from the opposite sides thereof.

3. The anchor lock fastening assembly of claim 2 wherein the limited vertical movement produced by the floating vertical position of the rail is controlled by providing a gap between the anchor lock lateral protrusions and the engaging portion of the rail anchors.

4. The anchor lock fastening assembly of claim 3 wherein the movement of the floating rail is slowed down by the disposition of an elastic means in said gap.

5. The anchor lock fastening assembly of claim 2 wherein the limited vertical movement produced by the floating vertical position of the rail is slowed down by an elastic portion disposed in the lateral anchor lock protrusions.

6. The anchor lock fastening assembly of claim 2 wherein the anchor lock protrusions contain sufficient elasticity to permit elastically restrained vertical movement between the floating rail and the tie.

7. The anchor lock fastening assembly of claim 2 wherein the lateral anchor lock protrusions are recessed within the lateral surfaces of the cross ties.

8. The anchor lock fastening assembly of claim 2 wherein the lateral anchor lock protrusions extend from the lateral surfaces of the cross ties.

9. The anchor lock fastening assembly of claim 2 wherein the lower portion of the anchor lock plate or attachment has a dovetailed configuration which holds the anchor plate within the tie.

10. The anchor lock fastening assembly of claim 9 wherein when the tie is concrete, said anchor lock plate is an insert to be confined and fixed within the dimensional limits of the railroad cross tie.

11. The anchor lock fastening assembly of claim 1 wherein an elastic pad is disposed under the base of the rail and is under no compressive constraint other than that exerted by the weight of the rail and traffic loads.

12. The anchor lock fastening assembly of claim 1 wherein the anchor lock plate is made of an electrically insulating material which extends vertically downward on both sides of the tie to provide an insulating element between the rail anchor and the concrete tie and is also provided with a dovetailed configuration which holds the anchor lock plate or attachment to the railroad tie.

13. The anchor lock fastening assembly of claim 1 wherein when the tie is wood, said anchor lock plate is adapted to be fixed to the upper surface of the tie and the lateral protrusions extend beyond the lateral sides of the tie.

14. The substantially load free anchor lock fastening assembly of claim 1 wherein the anchor lock plate or attachment is made of high density polyethylene.

15. A substantially load free anchor lock fastening assembly which comprises an anchor lock and a rail anchor, said anchor lock forming part of a plate or attachment to a tie or rail support and containing lateral recessed portions extending into the tie at opposite sides thereof, and said rail anchor being unitary and containing protruding, engaging portions disposed thereon, said protruding portions loosely engaging said lateral recessed portions so as to enable the rail anchor to control both the vertical and the longitudinal positions of the rail without exerting compressive forces between the rail and the rail support, said substantially load free fastening of the rail leaving the rail free to float.

16. The anchor lock fastening assembly of claim 15 wherein the limited vertical movement produced by the floating vertical position of the rail is controlled by providing a gap between the anchor lock lateral recessed portions and the protruding, engaging portions of the rail anchors.

17. The anchor lock fastening assembly of claim 16 wherein the limited vertical movement between the floating rail and the tie is achieved by an elastic portion disposed in the lateral anchor lock recesses.

18. The anchor lock fastening assembly of claim 15 wherein the recessed portions are lined with an insulating material.

19. The anchor lock fastening assembly of claim 15 wherein the anchor lock comprises an anchor lock plate having a symmetrical configuration.

* * * * *